US011213175B1

(12) United States Patent
Wise

(10) Patent No.: US 11,213,175 B1
(45) Date of Patent: Jan. 4, 2022

(54) AUTOMATIC LIFTING TOILET SEAT APPARATUS

(71) Applicant: David Wise, Lancaster, PA (US)

(72) Inventor: David Wise, Lancaster, PA (US)

( * ) Notice: Subject to any disclaimer, the term of this patent is extended or adjusted under 35 U.S.C. 154(b) by 0 days.

(21) Appl. No.: 17/032,107

(22) Filed: Sep. 25, 2020

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1–246.5
See application file for complete search history.

(56) References Cited

U.S. PATENT DOCUMENTS 4,055,864 A * 11/1977 Liu ..... E03D 5/04 4/253
5,323,497 A * 6/1994 Lih ..... A47K 13/10 297/DIG. 10
5,642,532 A 7/1997 Morant
6,012,180 A 1/2000 Williams
7,334,271 B2 2/2008 Jung
7,636,956 B1 * 12/2009 Doucet ..... A47K 13/10 4/246.1
7,788,741 B2 * 9/2010 Lohss ..... A47K 13/10 4/246.1
D687,933 S 8/2013 Kennedy
8,640,268 B2 2/2014 Shek
8,739,321 B2 6/2014 Trout
10,492,650 B2 12/2019 Holbrook

FOREIGN PATENT DOCUMENTS

WO WO2014036523 3/2014

* cited by examiner

*Primary Examiner* — Christine J Skubinna

(57) ABSTRACT

An automatic lifting toilet seat apparatus for raising the toilet seat after use to prevent mess includes a pair of seat sprockets is coupled to a seat back side of a toilet seat. A hinge pin is coupled to the pair of seat sprockets. A pair of hinges coupled to a toilet receives the hinge pin. A pair of lifter tracks is toothed and in operational communication with the pair of seat sprockets to rotate the hinge pin and lift the toilet seat. A drive cylinder is coupled within a cover coupled to the toilet and is in operational communication with the pair of lifter tracks. A motor is coupled to the cover and is in operational communication with the drive cylinder. The motor is in operational communication with a motion sensor of the toilet to automatically lift the toilet seat after use and before flushing.

7 Claims, 6 Drawing Sheets

AUTOMATIC LIFTING TOILET SEAT APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to toilet seat devices and more particularly pertains to a new toilet seat device for raising the toilet seat after use to prevent mess.

(2) Description of Related Art Including Information Disclosed Under 37 CFR 1.97 and 1.98

The prior art relates to toilet seat devices. Existing devices automatically lift and lower toilet seats, typically with a control button or to automatically default the seat to the lowered position. Such devices are typically incorporated into the toilet and do not function as add-ons to existing toilets. These known devices do not interact with the existing motion sensors of public toilets to lift the seat after use and before flushing.

BRIEF SUMMARY OF THE INVENTION

An embodiment of the disclosure meets the needs presented above by generally comprising a toilet seat. A pair of seat sprockets is coupled to a seat back side of the toilet seat. A hinge pin is coupled to the pair of seat sprockets. A pair of hinges hingingly receives the hinge pin. The pair of hinges is configured to be coupled to a toilet. A pair of lifter tracks is toothed and in operational communication with the pair of seat sprockets to rotate the hinge pin and lift the toilet seat. A cover slidingly receives the pair of lifter tracks and is configured to be coupled to the toilet. A drive cylinder is coupled within the cover. The drive cylinder has a pair of outer cylinder sprockets in operational communication with the pair of lifter tracks. A motor is coupled to the cover. The motor has a drive shaft extending into the cover and is in operational communication with the drive cylinder. The motor is configured to be in operational communication with a motion sensor of the toilet to automatically lift the toilet seat after use and before flushing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
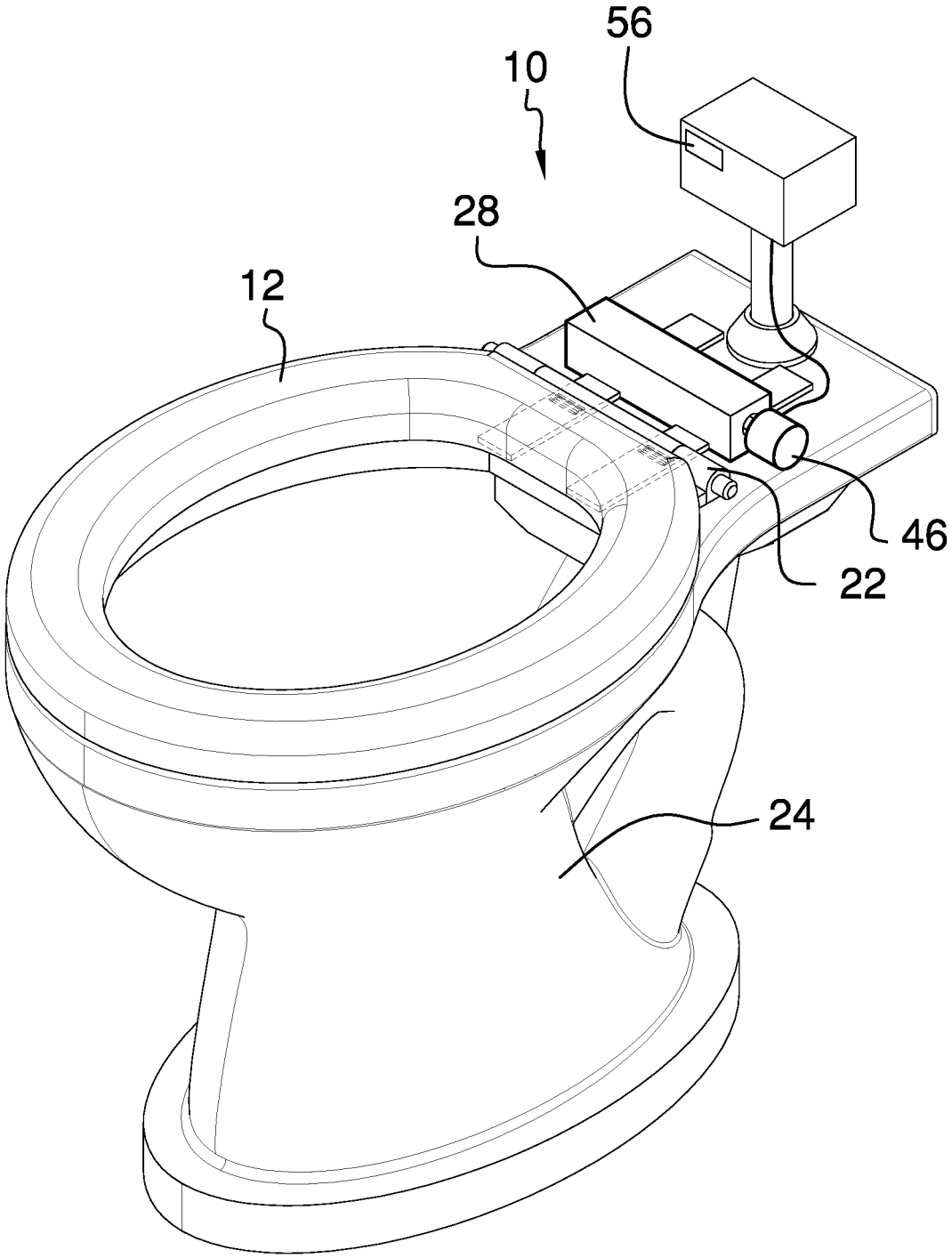
FIG. 1 is an isometric view of an automatic lifting toilet seat apparatus according to an embodiment of the disclosure.
Figure 2:
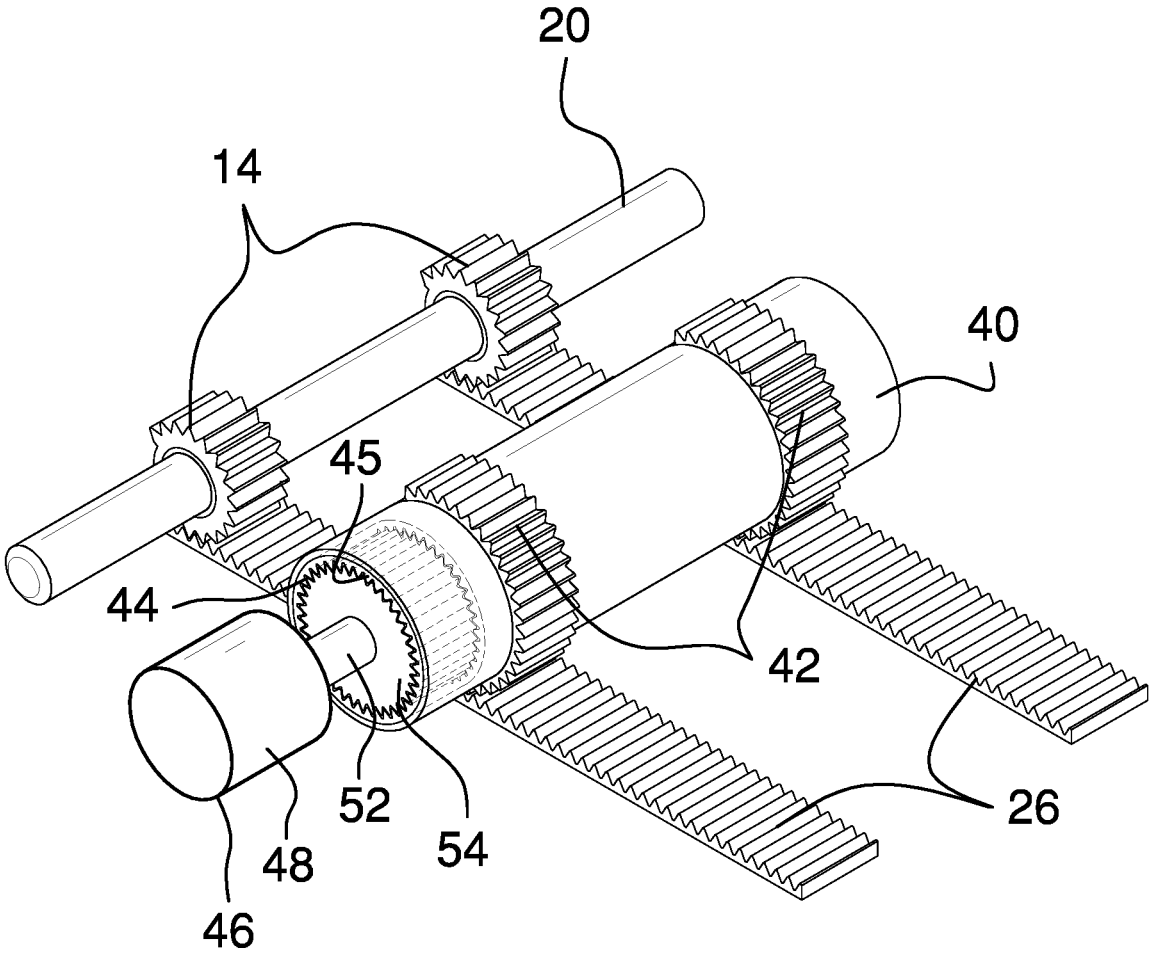
FIG. 2 is a detail view of an embodiment of the disclosure.
Figure 3:
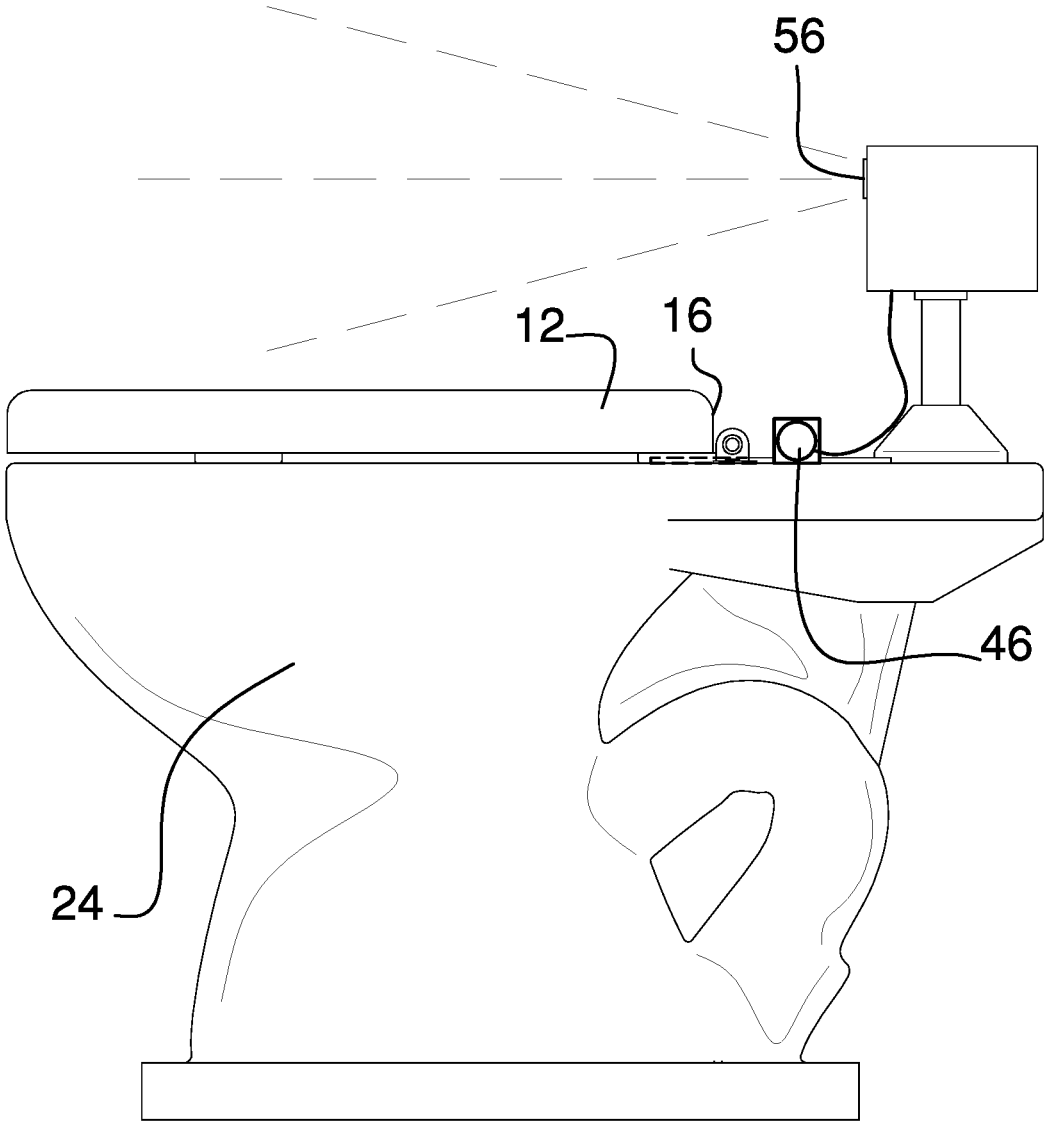
FIG. 3 is a side elevation view of an embodiment of the disclosure.
Figure 4:
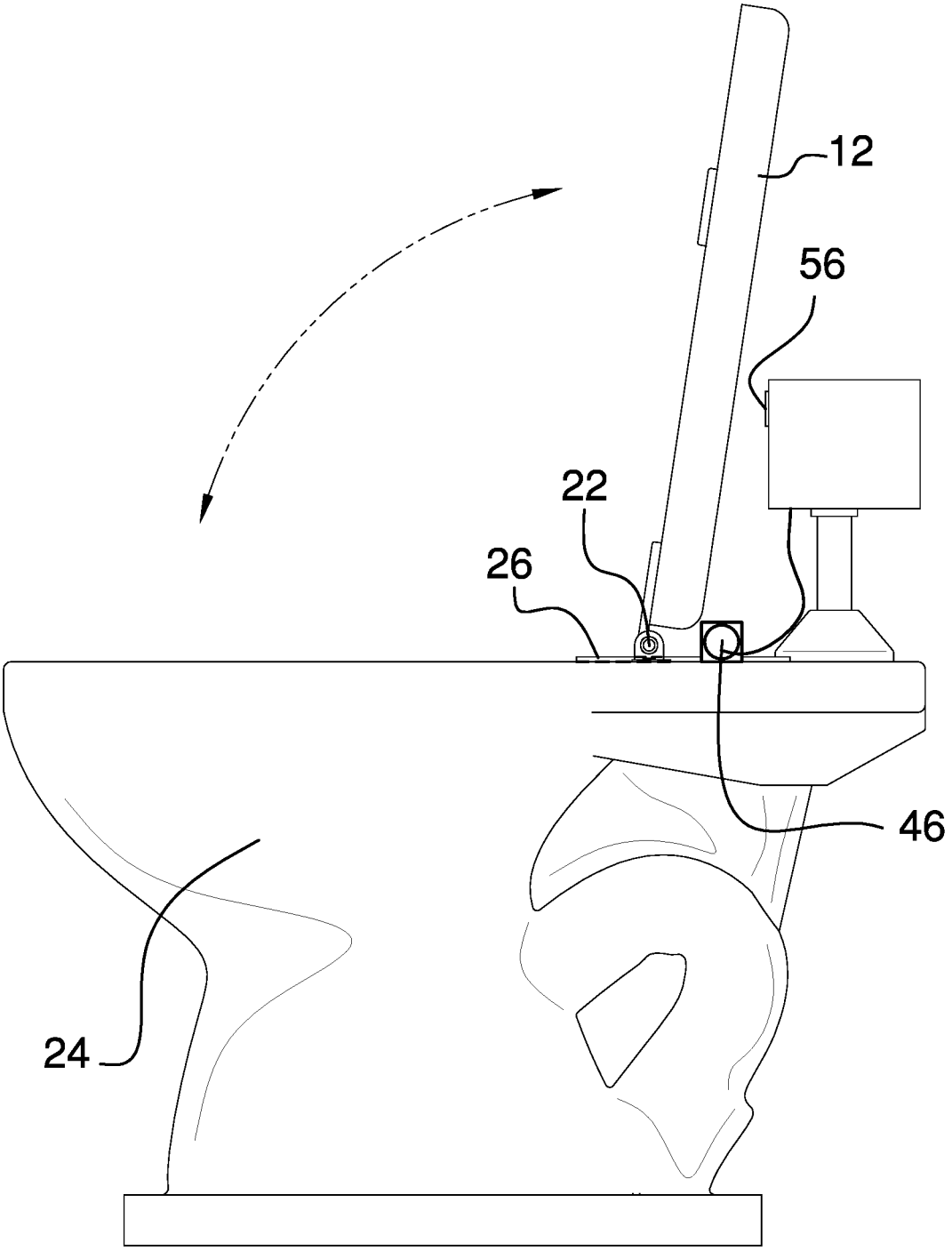
FIG. 4 is a side elevation view of an embodiment of the disclosure.
Figure 5:
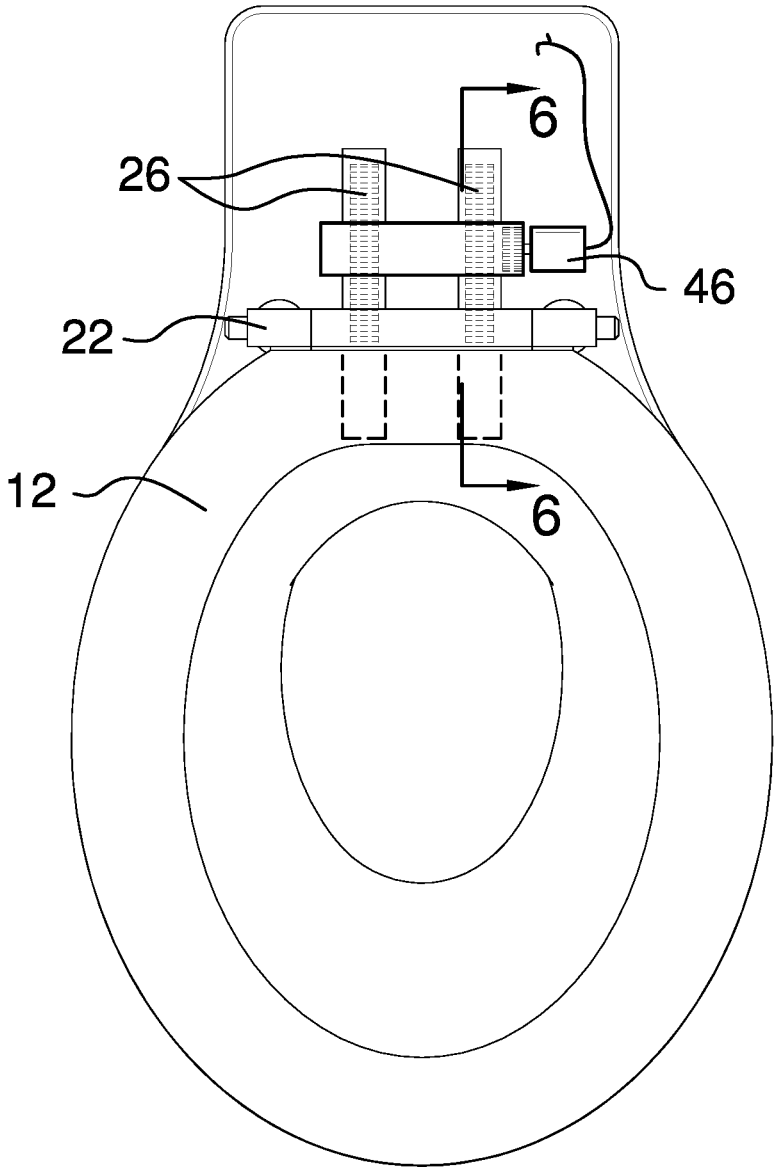
FIG. 5 is a top plan view of an embodiment of the disclosure.
Figure 6:
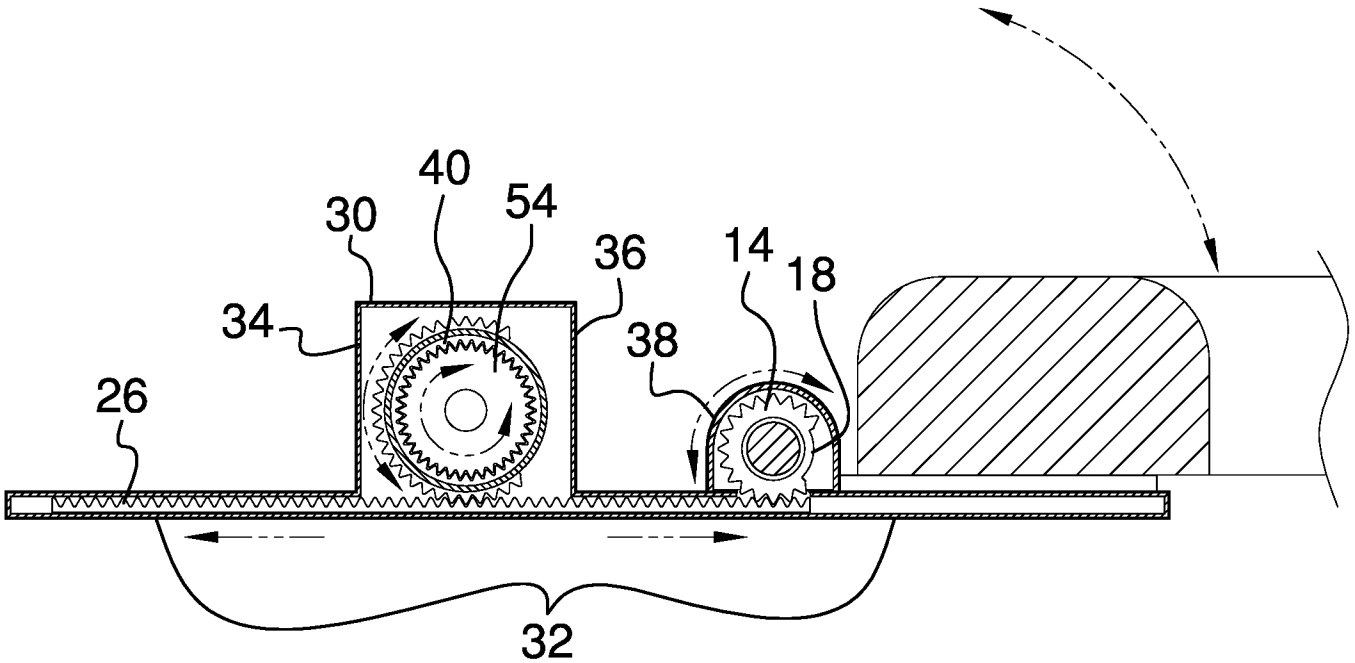
FIG. 6 is a cross-sectional view of an embodiment of the disclosure.

With reference now to the drawings, and in particular to FIGS. 1 through 6 thereof, a new toilet seat device embodying the principles and concepts of an embodiment of the disclosure and generally designated by the reference numeral 10 will be described.

As best illustrated in FIGS. 1 through 6, the automatic lifting toilet seat apparatus 10 generally comprises a toilet seat 12 and a pair of seat sprockets 14 coupled to a seat back side 16 of the toilet seat. Each seat sprocket 14 may have a non-toothed portion 18 to engage the seat back side 16. A hinge pin 20 is coupled to the pair of seat sprockets 14 and a pair of hinges 22 hingingly receives the hinge pin 20. The pair of hinges 22 is configured to be coupled to a toilet 24. The toilet seat 12 thus operates like a traditional toilet seat on the toilet 24.

A pair of lifter tracks 26 is toothed and in operational communication with the pair of seat sprockets 14. As the pair of lifter tracks 26 moves translationally it causes the pair of seat sprockets 14 to rotate the hinge pin 20 and lift the toilet seat 12 from a closed position in shown FIG. 3 to a lifted position shown in FIG. 4.

A cover 28 may have a rectangular prismatic main portion 30 and a pair of track extension portions 32 extending from a cover front side 34 and a cover back side 36. The pair of track extension portions 32 slidingly receives the pair of lifter tracks 26. The cover 28 may also have a semi-cylindrical sprocket portion 38 extending from each track extension portion 32 to receive the pair of seat sprockets 14. The cover 28 is configured to be coupled to the toilet 24.

A drive cylinder 40 is coupled within the cover 28. The drive cylinder 40 is coupled within the main portion 30. The drive cylinder 40 has a pair of outer cylinder sprockets 42 in operational communication with the pair of lifter tracks 26. The drive cylinder 40 may also have an internal sprocket 44 coupled within a cylinder left side 45 of the drive cylinder.

A motor 46 is coupled to the cover 28. The motor 46 may have a cylindrical motor housing 48 coupled to a cover left side 50 of the main portion. A drive shaft 52 of the motor extends into the main portion 30 and a motor sprocket 54 coupled to the drive shaft 52 is in operational communication with the internal sprocket 44 of the drive cylinder. The motor 46 thus drives the drive cylinder 40 which in turn translates the pair of lifter tracks 26 to rotate the pair of seat sprockets 14 and the hinge pin 20 to lift the toilet seat 12. The motor 46 is configured to be in operational communication with a motion sensor 56 of the toilet.

In use, the motion sensor 56 detects the presence of a user to activate the motor 46 to automatically lift the toilet seat 12 after use and before flushing to prevent mess. The toilet seat 12 thus is always in the lifted position when a user enters the bathroom and during a flush.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automatic lifting toilet seat apparatus comprising:

a toilet seat;

a pair of seat sprockets coupled to a seat back side of the toilet seat;

a hinge pin coupled to the pair of seat sprockets;

a pair of hinges, the pair of hinges hingingly receiving the hinge pin, the pair of hinges being configured to be coupled to a toilet;

a pair of lifter tracks, the pair of lifter tracks being toothed and in operational communication with the pair of seat sprockets to rotate the hinge pin and lift the toilet seat;

a cover, the cover slidingly receiving the pair of lifter tracks and being configured to be coupled to the toilet;

a drive cylinder coupled within the cover, the drive cylinder having a pair of outer cylinder sprockets in operational communication with the pair of lifter tracks; and a motor coupled to the cover, the motor having a drive shaft extending into the cover and in operational communication with the drive cylinder, the motor being configured to be in operational communication with a motion sensor of the toilet to automatically lift the toilet seat after use and before flushing.

2. The automatic lifting toilet seat apparatus of claim 1 further comprising the cover having a rectangular prismatic main portion to receive the drive cylinder.

3. The automatic lifting toilet seat apparatus of claim 2 further comprising the cover having a pair of track extension portions extending from a cover front side and a cover back side, the pair of track extension portions receiving the pair of lifter tracks.

4. The automatic lifting toilet seat apparatus of claim 3 further comprising the cover having a semi-cylindrical sprocket portion extending from each track extension portion to receive the pair of seat sprockets.

5. The automatic lifting toilet seat apparatus of claim 1 further comprising the drive cylinder having an internal sprocket, the motor having a motor sprocket coupled to the drive shaft, the motor sprocket being in operational communication with the internal sprocket of the drive cylinder.

6. The automatic lifting toilet seat apparatus of claim 1 further comprising the motor having a cylindrical motor housing coupled to a cover left side of the cover.

7. An automatic lifting toilet seat apparatus comprising:

a toilet seat;

a pair of seat sprockets coupled to a seat back side of the toilet seat;

a hinge pin coupled to the pair of seat sprockets;

a pair of hinges, the pair of hinges hingingly receiving the hinge pin, the pair of hinges being configured to be coupled to a toilet;

a pair of lifter tracks, the pair of lifter tracks being toothed and in operational communication with the pair of seat sprockets to rotate the hinge pin and lift the toilet seat;

a cover, the cover having a rectangular prismatic main portion and a pair of track extension portions extending from a cover front side and a cover back side, the pair of track extension portions slidingly receiving the pair of lifter tracks, the cover having a semi-cylindrical sprocket portion extending from each track extension portion to receive the pair of seat sprockets, the cover being configured to be coupled to the toilet;

a drive cylinder coupled within the cover, the drive cylinder being coupled within the main portion the drive cylinder having a pair of outer cylinder sprockets in operational communication with the pair of lifter tracks, the drive cylinder having an internal sprocket; and a motor coupled to the cover, the motor having a cylindrical motor housing coupled to a cover left side of the cover, a drive shaft extending into the cover, and a motor sprocket coupled to the drive shaft, the motor sprocket being in operational communication with the internal sprocket of the drive cylinder, the motor being configured to be in operational communication with a motion sensor of the toilet to automatically lift the toilet seat after use and before flushing.

* * * * *